United States Patent [19]

Prior

[11] 4,360,367

[45] Nov. 23, 1982

[54] DISCHARGE ELECTRODE ASSEMBLY AND ITS MANUFACTURE

[75] Inventor: William F. Prior, Glendale, Ariz.

[73] Assignee: Dresser Industries, Inc., Dallas, Tex.

[21] Appl. No.: 295,970

[22] Filed: Aug. 25, 1981

[51] Int. Cl.[3] ..... B03C 3/16; B03C 3/41; H01J 9/02

[52] U.S. Cl. ..... 55/145; 55/118; 55/150; 29/25.14; 29/825; 29/863

[58] Field of Search ..... 55/118, 141, 143, 145, 55/150, 13, 147–149; 29/25.14, 25.17, 825, 863

[56] References Cited

U.S. PATENT DOCUMENTS

| | | | |
|---|---|---|---|
| 1,454,255 | 5/1923 | Weiskopf | 55/150 |
| 1,896,758 | 2/1933 | Strigel et al. | 55/141 |
| 2,666,495 | 1/1954 | Hull | 55/150 |
| 3,570,219 | 3/1971 | Schmitz | 55/148 |
| 4,022,594 | 5/1977 | Baysek | 55/150 |

FOREIGN PATENT DOCUMENTS

| | | | |
|---|---|---|---|
| 1008259 | 5/1957 | Fed. Rep. of Germany | 55/150 |
| 2031704 | 12/1971 | Fed. Rep. of Germany | 55/150 |
| 2045647 | 11/1980 | United Kingdom | 55/147 |

*Primary Examiner*—David L. Lacey

[57] ABSTRACT

A discharge electrode assembly (14) and the method of assembly thereof for use in a wet electrostatic precipitator includes a flat grid-like frame comprised of four vertical tubes 50, 52, 54, 56 and a pair of horizontal tubes (58, 60). Crimpable tubes (70, 72) are welded in holes formed in the end vertical tubes in a staggerred relationship to engage the tip ends of electrode wire segments (62, 64). Such wires are generally J-shaped and are inserted into the crimp tubes so that each pair of adjacent wires forms a single loop. The wires are secured to the frame only at their ends by crimping the crimp tubes.

3 Claims, 7 Drawing Figures

DISCHARGE ELECTRODE ASSEMBLY AND ITS MANUFACTURE

BACKGROUND OF THE INVENTION

The present invention generally relates to electrostatic precipitators and more particularly to an improved discharge electrode assembly for an electrostatic precipitator and a method of manufacturing the discharge electrode assembly.

Trade literature by the Envirotech Corporation entitled, Fluid-Ionic Systems Fluid-Plate Modular Wet Precipitator, discloses a wet electrostatic precipitator that uses flat discharge electrode assemblies. The electrode assemblies include an electrode frame comprised of a rectangular grid of tubing made of a corrosion resistant metal and electrode wires welded to the frame. According to one method of manufacture of a test precipitator, the electrode wires were welded to the electrode frame. However, it was discovered that the welding created two problems. First, quite often the entire welded assembly warped upon cooling, thus making it unacceptable since it would not generate a uniform electrostatic field. Second, it would not be easy to remove an electrode wire welded to the frame if, after much use, the wire deteriorates. It would therefore be possible that due to the difficulty in replacing the electrode wires, the entire frame and wire assembly may be discarded or scrapped when the electrode wires break or deteriorate. Due to the relatively high cost of the corrosion resistant tubing used to make the electrode frame, such disposal would result in a considerable expense if the entire assembly were to be replaced.

SUMMARY OF THE INVENTION

The present invention concerns an improved discharge electrode assembly for an electrostatic precipitator and a method of manufacture thereof that eliminates the need for welding the electrode wires to the electrode frame and which is capable of reconstruction by the user in the field with relatively easy disassembly of the electrode wires from the electrode frame and thereafter with convenient reassembly of new electrode wires into the used electrode frame. A discharge electrode assembly constructed in accordance with the present invention includes an electrode frame having at least two spaced apart vertical members and two interconnected cross members, apertures formed at selected spacings in said vertical members, and tubes affixed within said apertures so that the tubes extend in the plane of the frame. The ends of at least some of said tubes are crimpable and project substantially outwardly of the associated vertical members at both of its ends. Electrode wire segments are received in said tubes, and each segment has a J-shape. The straight portion of each segment is received within and extends between a pair of tubes that are respectively affixed to the spaced apart vertical frame members, and the inwardly projecting end of one of said tubes is crimped to secure the corresponding end of the segment to the electrode frame. Each wire segment further includes a curved portion extending between a pair of vertically adjacent tubes to extend outwardly of the vertical frame members in the plane of the frame and the outwardly projecting end of one of said adjacent tubes is crimped to secure the curved wire portion to the electrode frame.

The discharge electrode assembly is preferably manufactured by a method including the steps: drilling an equal number of uniformly spaced, aligned bores in first and second frame members, affixing a tube in each of said bores, securing at least two cross members between said first and second tubular members so that the frame and cross members together form a rectangular frame, so that the tubes are aligned with the plane of the rectangular frame and so that the tubes of the first and second members are aligned with each other, forming several electrode wire segments each into a J-shape including a straight portion terminating in a first end and a curved portion terminating in a second end, inserting the formed electrode wire segments into the tubes so that (a) the first ends of one half of electrode wire segments are engaged in the inner ends of the tubes affixed to one of the frame members, so that (b) the second ends of said half of the segments are engaged in the outer ends of the tubes affixed to the other frame member, so that (c) the first ends of the remaining half of the segments are received in the inner ends of the tubes that received the second ends of the aforesaid other half of the wire segments, and so that the second ends of the remaining half of the segments are received in the outer ends of the tubes that received the first ends of the other half of the wire segments, whereby the adjacent pairs of electrode wire segments each form a loop, and crimping the ends of those tubes that receive the tip ends of the wire segments to secure the electrode wire segments to the frame.

The crimped connection of the electrode wires to the frame eliminates the aforementioned warpage problem associated with welding, thus providing an electrode assembly that is flat and thus adapted to generate a uniform electrostatic field. Also, if the electrode wire (or portion thereof) becomes corroded or otherwise needs replacement, the crimped ends of the associated pair of crimp tubes can be cut to remove a defective electrode wire, and a new electrode wire may be easily reinserted and crimped in place.

DESCRIPTION OF THE PREFERRED EMBODIMENT

Figure 1:
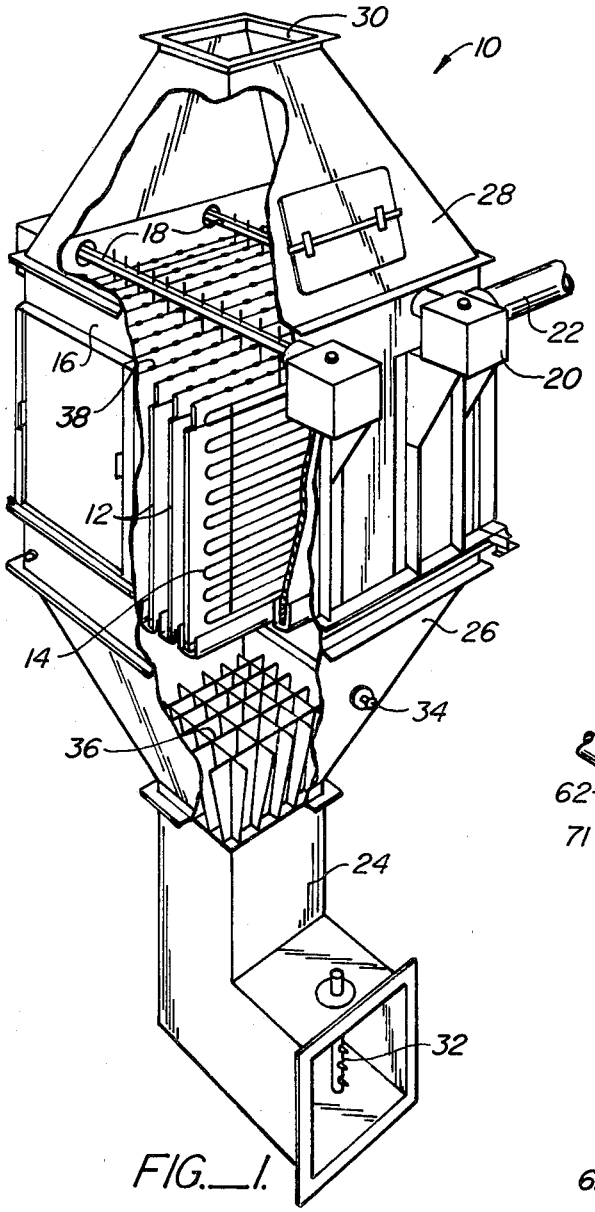
FIG. 1 is a somewhat diagrammatic isometric view of the preferred embodiment of a wet electrostatic precipitator, with parts thereof being broken away to illustrate the positioning of the improved discharge electrode assembly of the present invention.

Referring now more particularly to FIG. 1, it will be seen that a wet electrostatic precipitator 10 includes a plurality of flat collector plates 12 and a discharge electrode 14 disposed between adjacent collector plates.

The collector plates 12 are arranged in uniformly spaced vertical relationships within a rectangular housing 16. The discharge electrodes 14 are vertically suspended from a pair of overhead electrode support beams 18 made from electrically conductive metal pipe. The electrodes are vertically suspended so that each electrode is equidistantly spaced between each adjacent pair of collector plates. The ends of the support beams are suspended within boxes 20 so that the support beams are electrically insulated from the housing 16. The support beams are charged by a high voltage bus 22 connected to the end of the one of the support beams. In this manner, the discharge electrodes 14 are charged through their connection to the beams 18.

The gas to be treated is fed into an elbow 24 connected to the lower end of an air inlet hood 26 that is, in turn, connected to the lower end of the housing 16. A discharge hood 28 is connected to the upper end of the housing 16, and the gas having particulates or droplets removed therefrom is discharged through an opening 30 in the upper end of the upper hood. Scrubber sprayers 32 and 34 are respectively mounted to the air inlet hood 26 and elbow 24 to spray the incoming gas. A straightening vane assembly 36 of an egg-crate construction is provided at the entrance end of the inlet hood.

Water or other suitable liquid is pumped from nozzles 38 arranged in uniformly spaced locations along the upper end of each collector plate 12. More particularly, a header tube is connected between the sidewalls of the housing at the top end of each collector plate, and a plurality of nozzles are arranged along the upper end of each header member. Liquid is provided to the header tube to flush particles or droplets attracted to the collector plates as a result of the electrostatic field generated between the discharge electrodes 14 and the collector plates. The liquid distributed over the plates is collected in troughs arranged directly below the collector plates.

The present invention concerns an improvement in the construction of the electrode assemblies 14. Each of the electrode assemblies 14 is identically constructed and includes four vertical members 50, 52, 54, 56 and upper and lower horizontal members 58 and 60. Such members are constructed from tubing made of high corrosion resistant material such as a high nickel alloy steel. The members are welded to form a relatively rigid grid-like structure for supporting the electrode wires. The frame is connected to the support beams 18 by threaded rods 51 and 53 that extend vertically upwardly from the upper cross member 58.

The electrode wires are comprised of several pairs of J-shaped wire segments 62 and 64. Each pair of wire segments 62 and 64 are assembled in the frame to form a loop, and the several loops are uniformly vertically spaced along the vertical support members 50, 52, 54, 56. The J-shaped wire segments are mechanically connected to the end vertical members 50 and 56 by crimp tubes 70 and 72, respectively. The crimp tubes are welded to the end vertical members 50 and 56 and are long enough so that both ends thereof project substantially outwardly of the associated frame member. The crimp-connected points at the tip ends of the segments, together with the loose contacts between guide tubes 74 and the wire segments, enables the electrode wire loops to be charged with high voltage via the frame, which frame is connected to the electrically charged support beams 18, as shown in FIG. 2.

Figure 4:
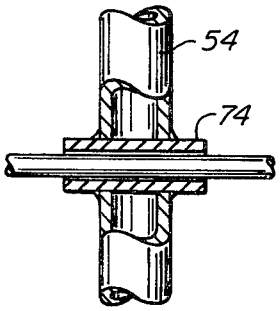
FIG. 4 is an enlarged fragmentary view taken as indicated in FIG. 3.
Figure 5A:
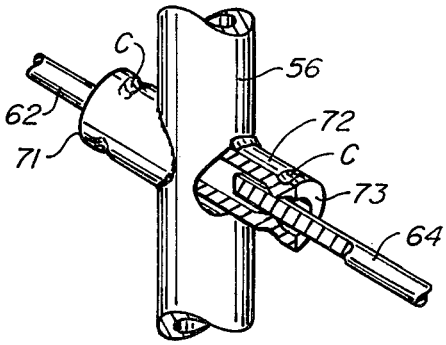
FIG. 5A is an enlarged fragmentary view showing a crimped tube engaged against the end of an electrode wire segment.
Figure 3:
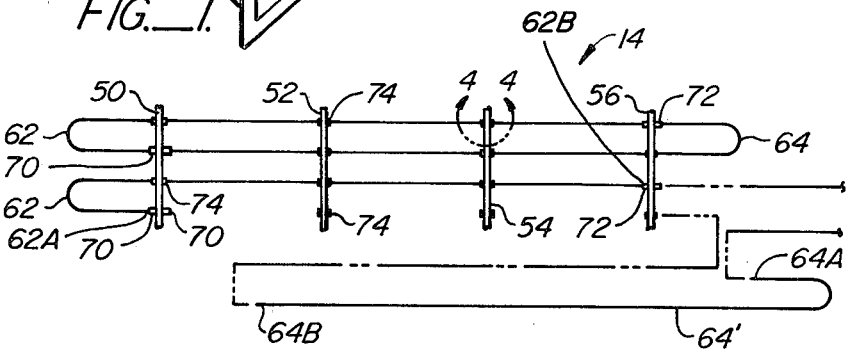
FIG. 3 is a fragmentary side elevation that illustrates a J-shaped electrode wire and its insertion into a partially assembled electrode assembly.
Figure 2:
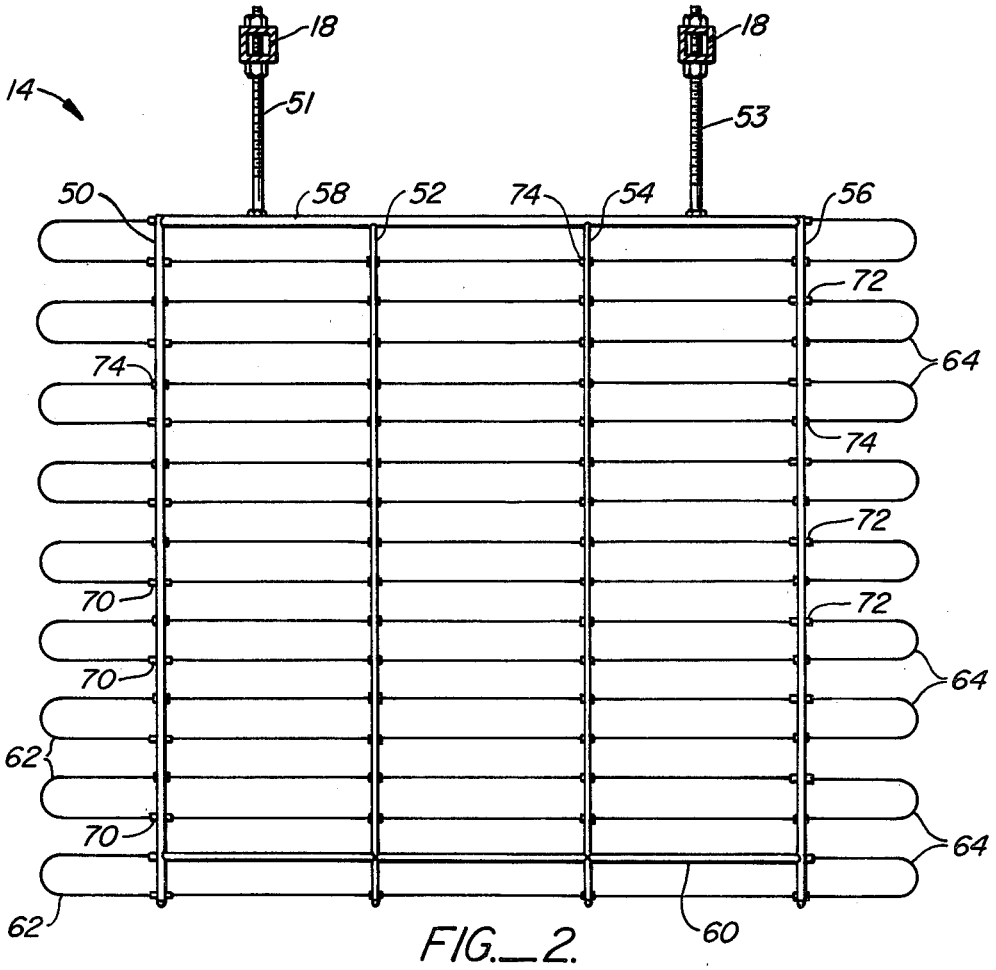
FIG. 2 is a side elevation of the improved discharge electrode assembly.

Referring to FIGS. 2, 3 and 5A, B, and C, the four vertical frame members 50, 52, 54, 56 have apertures drilled therein at uniform intervals. As shown in FIG. 4, the guide tubes or sleeves 74 are provided in the bores formed in the center vertical members 52 and 54. In the end vertical members 50 and 56, guide tubes 74 are provided in every other bore, and crimped tubes 70, 72 are provided in the remaining bores in the end members 50, 56. More particularly, the crimpable tubes 70 and 72 are affixed by welding in staggered relationships to the vertical members 50 and 56, respectively; and the crimp tubes 70 will be seen to be mounted lower than and midway between the crimp tubes 72 affixed to the other frame member 56. This staggered relationship of the crimp tubes enables the J-shaped wire segments 62, 64 to be inserted in the frame with tip ends of the curved portions of the wire segments being engaged in the outwardly projecting ends 73 (outer ends) of the crimp tubes and with the tip ends of the straight portions of the wire segments being engaged in the inwardly projecting ends 71 (inner ends) of the crimp tubes.

FIG. 3 illustrates the assembly of the electrode assembly 14. A wire segment 62 has already been inserted into the frame with the curved end 62A thereof being engaged in the outer end of the crimp tube 70 affixed to the frame member 50. The straight portion of the segment 62 has been threaded through the guide tubes 74 that are affixed to the end frame member 50 and the center two frame members 52, 54 and then into the inner end 71 (FIG. 5A) of the crimp tube 72 attached to the other end frame member 56. The segment 62 may then be secured to the frame by crimping the outwardly projecting end of the crimp tube 70 and the inwardly projecting end of the crimp tube 72, thus tightly engaging the segment 62 only at its ends.

As shown in FIG. 3, the loose wire segment 64 (of an identical configuration as the wire segment 62) may next be inserted so that the end 64A of the curved portion of the segment is received in the outer end 73 (FIG. 5A) of the crimp tube and so that the end 64B of the straight portion of the segment is received in the inner end of the crimp tube 70 affixed to the frame member 50. The straight portion of the wire segment is threaded progressively through the vertically adjacent guide tube 74 affixed to the frame member 56 and then through the tubes 74 affixed to the center frame members 54 and 52. After the segment 64 has been so inserted into the frame, the outer end of the crimp tube 72 is crimped to secure the end of the curved portion of the segment to the frame member 56, and then the inner end of the crimp tube 70 is crimped to secure the end of the straight portion of the segment 64 to the frame member 50. The segments 62 and 64 will then form a complete loop.

Figure 5B:
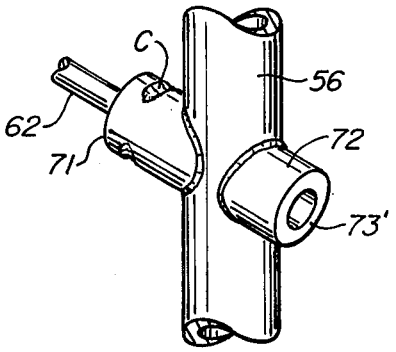
FIG. 5B is an enlarged fragmentary view illustrating the crimped tube after one of the electrode segments has been removed.
Figure 5C:
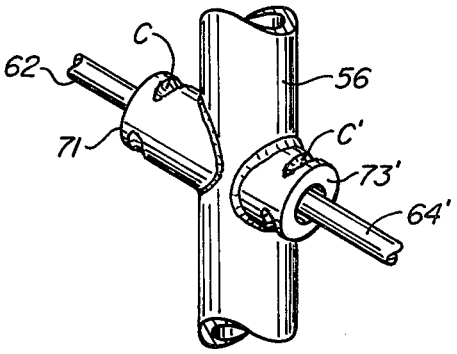
FIG. 5C shows a new wire segment secured to the frame by recrimping the remaining portion of the tube.

FIGS. 5A–5C illustrate the removal of a wire segment 64 a from a crimp tube 72 made possible by the present invention. Should the wire segment 64 become damaged during use, the outer end 73 of the crimp tube may be severed just inside the crimp area C on the inwardly projecting end 73 of the crimp tube. The inner end of the crimp tube 70 (not shown with reference to the same wire segment 64 as is shown in FIG. 5A) may be severed to free the other end of the wire segment 64. The wire segment 64 may then be removed from the guide tubes 74 affixed to the frame members, thus permitting a new wire segment to be inserted into the remaining portion of the crimp tube 72 (as shown in FIG. 5B). A new wire segment 64′ (FIG. 5C) may then be inserted into the new outer end 73′ of the crimp tube, and a new crimp C′ would then be formed to retain the new wire segment. The other end of the new segment 64′ would then be retained by crimping the remaining portion of the inwardly projecting end of the associated crimp tube 70 attached to the end frame member 50.

It is noted that the guide tubes 74 have an inner diameter slightly greater than the outer diameter of the wire segments 62, 64. The guide tubes thus permit the wire segments to move longitudinally therein in the event that the frame tends to warp under high temperature operating conditions. The entire discharge electrode assembly 14 thus has some flexibility due to the connection of the wire segment 62, 64 thereto only at their tip ends.

In summary, the discharge electrode assembly 14 is manufactured according to the following process. An equal number of uniformly spaced holes are bored in the frame members 50, 52, 54, 56. Such frame members are made from a corrosion resistant metal such as a high nickel alloy steel. The bores are drilled in alignment with each other in the respective frame members. Crimpable tubes 70 are welded in every other bore in the frame member 50, and crimpable tubes 72 are welded in every other bore in frame member 56. Guide tubes 74 are welded in the remaining bores in the frame members 50 and 56. Guide tubes 74 are also welded in the bores formed in the center frame members 52 and 54. Cross members 58 and 60 are then secured to the frame members 50, 52, 54, 56 so that the frame members 50, 52, 54, 56 are parallel to each other and perpendicular to the cross members 58 and 60. Care is taken to assure that the crimpable tubes and the guide tubes are all aligned with each other; that is, care is taken to assure that such tubes will lie in the plane of the welded rectangular frame assembly. Also, the frame members 50, 56 and the cross members 58 and 60 are affixed to each other so that the crimp tubes 70 of one of the frame members are staggered midway between the crimp tubes 72 associated with the other frame member.

J-shaped wire segments 62 and 64 are formed from relatively rigid wire made from the same corrosion resistant metal as the metal used to form the frame assembly. The wire segments 62 and 64 have identical J-shapes, each including a curved portion terminating in tip ends 62A and 64A, respectively and straight portions terminating in tip ends 62B and 64B, respectively.

The electrode wires, after they have been so formed, are inserted into the frame assembly comprised of the members 50, 52, 54, 56 so that the adjacent pairs of electrode wire segments (each pair including a segment 62 and a segment 64) form a loop and so that the discharge electrode assembly includes several vertically spaced wire loops (as shown in FIG. 2). One-half of the electrode wire segments, comprising the wire segments 62, are inserted into the frame so that the curved ends 62A thereof are received in the outer ends of the crimp tubes 70 and so that the tip ends 62B thereof are received in the inner ends of the crimp tubes 72 affixed to the other vertical frame member 56. The remaining half of the wire segments, comprising the segments 64, are inserted into the frame so that the tip ends 64A of the curved portions thereof are received in the outer ends of the crimp tubes 72 attached to frame member 56 and so that the tip ends 64B thereof are received in the inner ends of the crimp tubes 70 affixed to the other frame member 50. It will be understood that the wire segments may be assemblied in the frame in any desired sequence.

After being inserted into the crimp tubes, the ends of the crimp tubes are then crimped adjacent their tip ends to secure only the ends of the wire segment to the frame. It will be further understood that the crimp tubes may be crimped immediately after inserting the wire segment therein, or after all the segments have been inserted, or in any sequence that may be desired.

Although the best mode contemplated for carrying out the present invention has been shown and described, it will be apparent that modification and variation may be made without departing from what is regarded to the subject matter of the invention.

What is claimed is:

1. In an electrostatic precipitator including a housing, a plurality of generally planar extending discharge electrode assemblies having discharge electrodes, a plurality of generally planar extending collector plates, means for mounting the collector plates within the housing in vertical, horizonally spaced relationships, means for vertically mounting each of the discharge electrode assemblies within the housing equidistantly between the adjacent pairs of the collector plates, and means adapted for applying a voltage to the discharge electrodes of said discharge electrode assemblies to thereby form an electrostatic field between the electrodes and plates, the improvement comprising: each discharge electrode assembly including an electrode frame having at least two spaced apart vertical members and two interconnected cross members, apertures formed at selected spacings in said vertical members, tubes affixed within said apertures so that each tube extends in the plane of the frame, the ends of at least some of said tubes being of crimpable composition and projecting substantially outwardly of the associated vertical members at both ends, electrode wire segments received in said tubes, each wire segment being of a substantially J-shape with the sraight portion of each segment being received within and extending between a pair of tubes that are respectively affixed to the spaced apart vertical frame members, the inwardly projecting end of one of said pair of tubes being crimped to secure the corresponding end of the respective straight wire portion to the electrode frame, each wire segment further including a curved portion extending between a pair of vertically adjacent tubes to extend outwardly of the vertical frame members in the plane of the frame, the outwardly projecting end of one of each of said vertically adjacent tubes being crimped to secure the end of the associated curved wire portion to the electrode frame.

2. In the precipitator according to claim 1, wherein one half of the tubes affixed to each vertical frame member are of crimpable composition and include ends that project outwardly of the frame member, said crimpable tubes on one vertical frame member being vertically staggered with resepect to the crimpable tubes on the other vertical frame member, the substantially J-shaped wire segments being received in said tubes so that the adjacent pairs of electrode segments each form a separate loop, the curved ends of one-half of the wire segments being secured by the outer ends of first crimpable tubes affixed to one of the vertical frame members, the straight ends of the remaining half of the wire segments being secured by the inner ends of said first crimpable tubes, the straight ends of said first-mentioned half of the segments being secured by the inner ends of second crimpable tubes that are affixed to the other vertical frame member, and the curved ends of said remaining half of the electrode wire segments being secured by the outer ends of said second crimpable tubes affixed to said other frame member.

3. A method of manufacturing a discharge electrode assembly for use in an electrostatic precipitator comprising the steps of:

forming an equal number of uniformly spaced, aligned bores in first and second frame members, affixing a tube in each of said bores, securing at least two cross members extending transversely between said first and second frame members so that the frame members and cross members together form a rectangular frame with said tubes aligned with the plane of the rectangular frame and so that the tubes of the first and second frame members are aligned with each other, forming several electrode wire segments each into a substantially J-shape including a straight portion terminating in a first end and a curved portion terminating in a second end.

inserting the formed electrode wire segments into the tubes so that (a) the first ends of one half of electrode wire segments are engaged in the inner ends of first tubes affixed to one of the frame members, (b) the second ends of said one-half of the segments are engaged in the outer ends of second tubes affixed to the other frame member, (c) the first ends of the remaining half of the segments are received in the inner ends of said second tubes and (d) the second ends of said remaining half of the segments are received in the outer ends of said first tubes whereby the adjacent pairs of electrode wire segments each form a loop, and crimping the ends of those tubes that receive the ends of the wire segments to secure the electrode wire segments to the frame.

* * * * *